United States Patent [19]

Glick

[11] Patent Number: 4,807,807

[45] Date of Patent: Feb. 28, 1989

[54] ADHESIVE POSTCARD FOR ARTICLES

[76] Inventor: Eliot M. Glick, 199 Old Forest Hill Road, Toronto, Ontario, Canada, N6C 2H1

[21] Appl. No.: 48,971

[22] Filed: May 8, 1987

Related U.S. Application Data

[63] Continuation of Ser. No. 688,939, Jan. 4, 1985, abandoned, which is a continuation-in-part of Ser. No. 550,287, Nov. 9, 1983, abandoned, which is a continuation of Ser. No. 531,528, Sep. 12, 1983, abandoned.

[51] Int. Cl.[4] ..... B42D 15/02

[52] U.S. Cl. ..... 229/92.8; 40/159.2; 204/813; 283/112; 428/41

[58] Field of Search ..... 229/92.8, 92; 206/813; 40/158 R, 158 B; 428/40–43; 283/75, 109, 112

[56] References Cited

U.S. PATENT DOCUMENTS

| | | | |
|---|---|---|---|
| 922,035 | 5/1909 | Pifer | 229/92.8 X |
| 2,168,920 | 8/1939 | Wissman . | |
| 2,291,173 | 7/1942 | Simpson | 229/92.8 |
| 2,363,472 | 11/1944 | Ritter . | |
| 2,708,068 | 5/1955 | Guttman . | |
| 2,805,816 | 9/1957 | Morgan . | |
| 3,083,821 | 4/1963 | Woodson | 206/484 X |
| 3,153,868 | 10/1964 | Jones | 428/40 X |
| 3,190,541 | 6/1965 | McLauglin et al. . | |
| 3,193,182 | 7/1965 | Yakovljevic . | |
| 3,266,714 | 8/1966 | Heuberger . | |
| 3,304,641 | 2/1967 | Gonezy | 229/92.8 X |
| 3,329,333 | 7/1967 | Ormond | 229/92.8 |
| 3,346,172 | 10/1967 | Tucker . | |
| 3,505,140 | 4/1970 | Dunn | 283/109 X |
| 3,509,991 | 5/1970 | Hurst | 206/813 X |
| 3,582,439 | 6/1971 | Thomas | 229/68 C |
| 3,656,684 | 4/1972 | Meehan . | |
| 3,713,238 | 1/1973 | Hyman et al. . | |
| 3,762,630 | 10/1973 | Braznell . | |
| 3,827,726 | 8/1974 | McVoy et al. | 283/75 |
| 3,847,325 | 11/1974 | Naosalski et al. | 229/92.8 |
| 3,893,252 | 7/1975 | Chase . | |
| 3,894,684 | 7/1975 | Florey . | |
| 3,899,127 | 8/1975 | Melander | 229/73 |
| 3,986,283 | 10/1976 | Pelaez . | |
| 4,008,852 | 2/1977 | Davis | 229/92.3 |
| 4,031,640 | 6/1977 | Hanna Jr. et al. . | |
| 4,057,923 | 11/1977 | Chase . | |
| 4,079,881 | 3/1978 | Sabb | 229/92.8 |
| 4,132,480 | 1/1974 | Reed . | |
| 4,167,241 | 9/1979 | Zumbrunn . | |
| 4,231,833 | 11/1980 | Lieberman . | |
| 4,232,079 | 11/1980 | Raphael et al. | 283/109 X |
| 4,237,633 | 12/1980 | Murrell | 40/158 R |
| 4,248,919 | 2/1981 | Davis | 428/40 |
| 4,249,328 | 2/1981 | Plumadore | 40/158 B |
| 4,378,392 | 3/1983 | Segel | 428/40 |
| 4,378,647 | 4/1983 | Stancato | 40/158 R |

FOREIGN PATENT DOCUMENTS

| | | | |
|---|---|---|---|
| 1050652 | 2/1959 | Fed. Rep. of Germany | 229/92.8 |
| 7635605 | 5/1977 | Fed. Rep. of Germany . | |
| 7837645 | 12/1978 | Fed. Rep. of Germany . | |
| 8120727 | 7/1981 | Fed. Rep. of Germany . | |
| 20372 | 7/1978 | Japan . | |
| 6148 | 3/1909 | United Kingdom | 229/92.8 |

OTHER PUBLICATIONS

"Half-Lami Label" (Japan) (date unknown).

*Primary Examiner*—Jimmy G. Foster
*Assistant Examiner*—Bryon Gehman
*Attorney, Agent, or Firm*—Amster, Rothstein & Ebenstein

[57] ABSTRACT

A postcard is formed from a sheet-form member, for example a card, which is provided with a first layer of adhesive. An additional transparent sheet is provided. it is secured along one edge, preferably its upper edge, to the card. It is provided with a second layer of adhesive. A protective sheet is located between the two layers of adhesive to keep them separate. in use, a photograph or other article can be secured and sandwiched between the sheet-form member and the transparent sheet. For simplicity of production, all the components of the card have a uniform height across the width of the card to enable the postcards to be produced as an elongate strip which is cut to form individual postcards.

17 Claims, 3 Drawing Sheets

ADHESIVE POSTCARD FOR ARTICLES

This application is a continuation of application Ser. No. 688,939, filed Jan. 4, 1985, now abandoned, which is a continuation-in-part of my U.S. patent application Ser. No. 550,287 filed Nov. 9, 1983, now abandoned, which in turn is a continuation of my earlier U.S. patent application, Ser. No. 531,528 filed Sept. 12, 1983, now abandoned.

This invention relates to a postcard with an adhesive surface for articles, particularly photographs.

At the present time a wide variety of different postcards are known. Ordinary, plain postcards, one side of which is used for an address and the other side of which is used for messages, are used for ordinary communications purposes. For people on vacation and the like, there are a wide variety of different postcards provided with a photograph on one side. The other side of the card is then used for a short message and for the appropriate name and address. Typically, the photograph will show an attractive local scene. Alternatively, a number of small images of local scenes can be provided, and this is particularly suited to larger postcards. Such cards enable someone on vacation to send friends and relatives a picture of the resort or area where they are staying.

However, they only enable a general scenic picture to be sent, whereas friends and relatives would frequently be interested in receiving a photograph of the sender, and where appropriate his family. At the present time, this can only be achieved by sending a letter which is more costly and time consuming. Also, such cards are inconvenient from the manufacturer's viewpoint, as he has to produce a wide variety of different cards for different locations, and attempt to anticipate the varying demand for each card.

Various proposals have been made for devices for sending photographs through the mail. These devices are typically quite complex, which makes them costly to manufacture and difficult for someone to use. Also, some of the designs do not securely locate and protect the photograph.

In the applicant's first U.S. patent application, there is disclosed a postcard to which photographs and other articles can be affixed. An additional sheet is provided with removable panels, which can be selectively removed to permit different sized photographs or other articles to be stuck to the postcard. Whilst this postcard enables a photograph to be sent through the mail, it does not completely protect the photograph, and the provision of removable panels makes it relatively complex and costly.

A postcard, for sending photographs through the mail, should securely protect the photograph and should be easy for someone to use. Further, it should be capable of being mass-produced at low cost.

In accordance with the present invention, there is provided a postcard, for use in mailing a sheet-form article with one side of such a sheet-form article visible, the postcard comprising: a sheet-form member formed from a relatively stiff material for supporting such an article; a first layer of adhesive provided on one side of the sheet-form member; a transparent sheet which is secured along one edge portion to a corresponding edge portion of the sheet-form member; a second layer of adhesive on a side of the transparent sheet, with the first and second layers of adhesive facing one another; and a protective sheet positioned between the first and second layers of adhesive so as to maintain the sheet-form member and the transparent sheet separate from one another, with the exception of said edge portions, which protective sheet includes a rectangular tab extending across the width of the postcard from an edge of the transparent sheet opposite said one edge portion, whereby, in use, the protective sheet is removed and a sheet-form article is mounted between the sheet-form member and the transparent sheet and is adhered to the first and second layers of adhesive, to secure and protect the article, exposed portions of the first adhesive layer adhering to corresponding portions of the second adhesive layer, wherein each of the sheet-form member, the transparent sheet and the protective sheet are of uniform height across the width of the postcard.

The postcard can be of conventional postcard size, for example the postcard can be 6" wide and 4¼" high. The edge portions along which the sheet-form member and the transparent sheet are secured and the tab can extend along the longer sides of the postcard. Alternatively, in some cases, it may be preferable to provide the edge portions, securing the sheet-form member and the transparent sheet together, along the shorter side of the card, with the tab extending along the opposite, shorter side of the postcard.

A postcard in accordance with the present invention is intended for simple, cheap mass production. The various components of the postcard are so dimensioned, as to permit them to be formed from elongate strips of material. This is a particularly advantageous way of forming the postcard.

In accordance with another aspect of the present invention, there is provided a method of forming a postcard, for use in mailing sheet-form articles with one side of such a sheet-form article visible, the method comprising:

(i) Coating one side of a sheet-form member with an adhesive to form a first layer of adhesive;

(ii) Cutting the sheet-form member to form elongate strips having a width equal to one dimension of the postcard;

(iii) Coating one side of a transparent sheet with adhesive to form a second layer of adhesive;

(iv) Applying a protective sheet to the second layer of adhesive;

(v) Cutting the transparent and protective sheets to form strips having a width equivalent to one said dimension of the postcard and the depth of a tab;

(vi) Along one edge of each strip of the protective and transparent sheets removing one edge portion of the protective sheet, and along an opposite edge of each strip removing a portion of the transparent sheet having a width equal to the depth of said tab;

(vii) Securing each strip of the sheet-form member to a strip of the transparent and protective sheets, with said one edge portion of the transparent sheet adhering to a corresponding edge portion of the sheet-form member; and (viii) cutting each resultant strip comprising a part of the sheet-form member, a part of the protective sheet and a part of the transparent sheet into lengths equal to another required dimension of the postcard, to form finished postcards.

Thus, the method of the present invention provides a simple and economical method of manufacturing the postcards in accordance with the present invention.

The postcard of the present invention enables a user to send a card having, for example, photographs of himself, family or friends etc, instead of the usual scenic pictures on mass-produced postcards. The transparent sheet ensures that the photograph or other article is securely retained. It also ensures that a corner of the photograph cannot be snagged, during for example sorting of the mail, thereby detaching the photograph. The provision of adhesive layers on both the transparent sheet and the sheet-form member also ensures that the photograph is securely retained. Further, if desired, the adhesive used can be a pressure-sensitive adhesive, which permits a photograph to be removed from the postcard. Thus, not only does the postcard enable a user to make his own postcard, but it enables the receiver to remove the postcard for storage in a photograph album or the like.

The first layer of adhesive can be any suitable adhesive, which permits removal of a protective sheet, and will retain an article in position. It need not be transparent. The second layer of adhesive is preferably transparent and has similar adhesive properties to the first layer. However, the second layer of adhesive could be tinted, and this might even be desirable for some purposes.

To facilitate use of the postcard, the protective sheet or carrier should adhere more firmly to the second adhesive layer. This is preferably achieved by providing different coatings on either side of the protective sheet. Thus, the two coatings can either be different and/or they can be of a different composition. The protective sheet should adhere moderately to the second adhesive layer, whilst still permitting ready removal therefrom. For the first adhesive layer, there is preferably only light adhesion between it and the protective sheet. This then enables a user to lift up the protective sheet and the transparent sheet, by means of the tab of the protective sheet. A photograph is then positioned on the first adhesive layer. The protective sheet is removed, and the transparent sheet placed on top of the photograph and the first adhesive layer. If necessary, any bubbles trapped under the transparent sheet can be smoothed out by hand.

Whilst it is preferred for packs of postcards to include the necessary instructions, this preferred construction of the postcard should make it almost self-apparent how the postcard should be used. When a user opens the postcard, he will naturally lift the protective sheet with the transparent sheet; in other words, there should be no inclination for a user to separate the protective sheet from the transparent sheet first. Further, by providing ready separation between the protective sheet and the sheet-form member, damage to the transparent sheet can be avoided. If there is strong adhesion between the two, then when the transparent sheet and the protective sheet is lifted, the transparent sheet can be bent too sharply and can be cracked or otherwise damaged.

For a better understanding of the present invention, and to show more clearly how it may be carried into effect, reference will now be made to the accompanying drawings, which show an embodiment of the present invention and in which.

Figure 8:
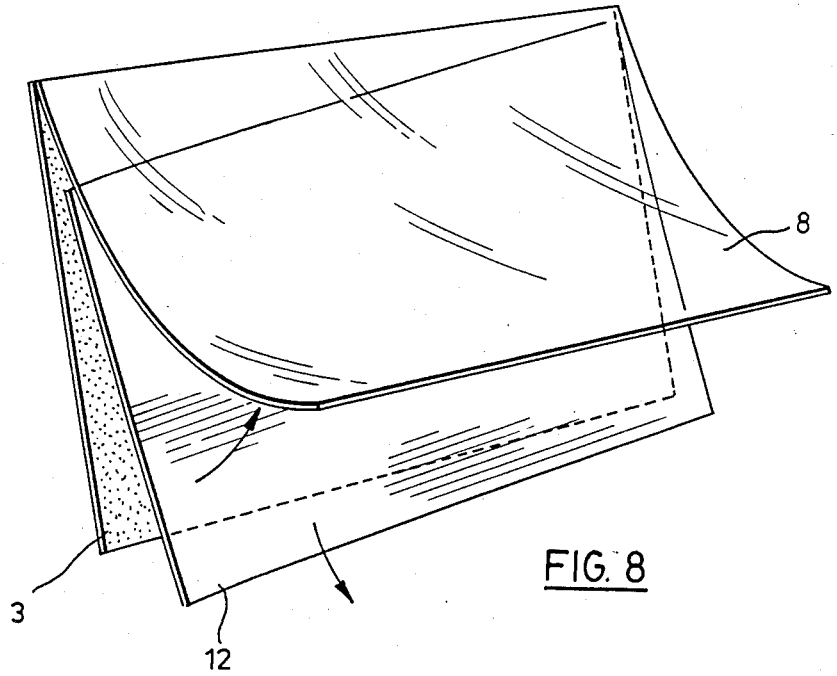
FIG. 8 shows a perspective view of the complete postcard with a protective sheet being removed.
Figure 9:
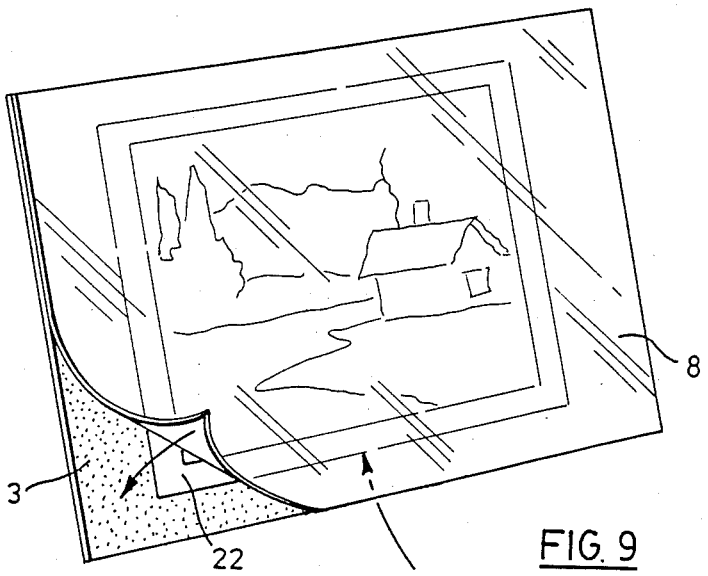

and FIG. 9 shows a perspective view, similar to FIG. 8, with a photograph mounted on the postcard.

Figure 1:
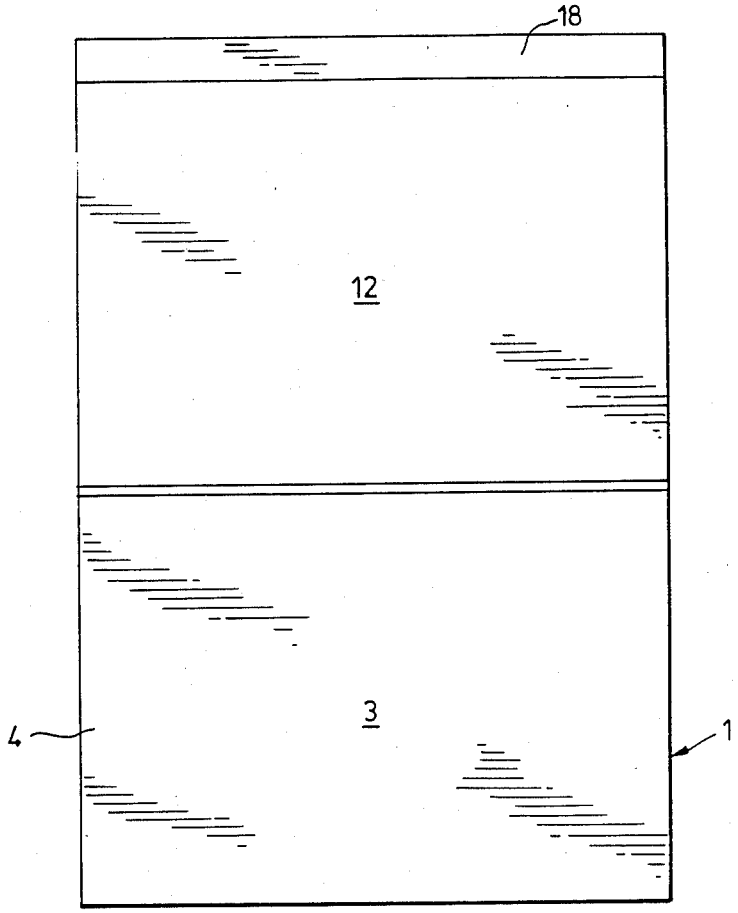
FIG. 1 shows a plan view, on one half scale, of a postcard in accordance with the present invention, when opened.

In the drawings, the postcard is generally denoted by the reference 1. In FIG. 1, the postcard is shown approximately half its full size, whilst in the remaining figures the height of the postcard is shown full size. For the purposes of clarity, the depth or thickness of the postcard is enlarged in FIGS. 2–7, to render the different layers clearer.

The postcard 1 has a sheet-form member 3, which can be formed from the usual card for postcards. It provides the main body of the postcard 1. As shown most clearly in FIGS. 2 and 3, an additional transparent sheet 8 is secured to the sheet-form member 3 along an edge portion 14. This is explained in greater detail below.

A first layer of adhesive 6 is provided on the sheet-member 3, extending all over an upper face of the sheet-form member 3. A second layer of adhesive 10 is provided on a corresponding face of the transparent sheet 8. Both these layers of adhesive 6, 10 are formed from pressure-sensitive adhesive. To keep these layers of adhesive 6, 10 separate, a protective or carrier sheet 12 is provided. It is such that it can be readily detached from the adhesive layers 6, 10, and for this purpose can be given a glossy finish.

Figure 2:
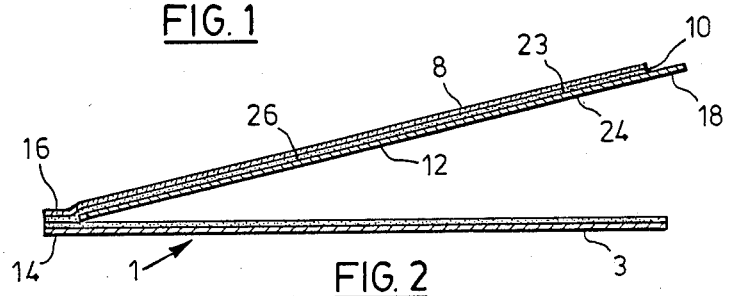
FIG. 2 shows a cross-section through the postcard of FIG. 1 when partially opened, the section being actual size.
Figure 3:
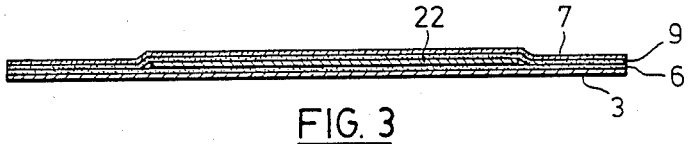
FIG. 3 shows the postcard of FIGS. 1 and 2 and a photograph mounted on the postcard in a section similar to FIG. 2.
Figure 4:
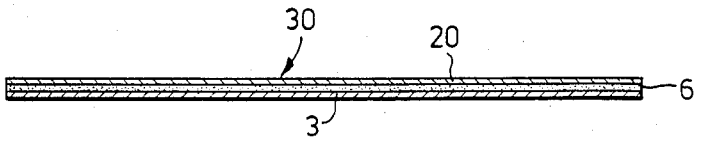
FIG. 4 shows a cross-section through some of the components of a postcard in accordance with the present invention, the section being actual size.

An edge portion of the protective sheet 12 is omitted, to enable corresponding portions of the first and second adhesive layers 6, 10 to be secured together, to hold secure the transparent sheet 8 to the sheet-form member 3. As shown in FIG. 2, this enables an edge portion 16 of the transparent sheet 8 to be secured to a corresponding edge portion 14 of the sheet-form member 3, by means of the exposed portions of the adhesive layers 6, 10.

As shown in FIGS. 1 and 2, the protective sheet 12 includes a rectangular tab 18. This tab 18 extends for the full width of the postcard 1, and has uniform height or depth.

All of the components of the postcard 1 are rectangular, and in particular are of uniform height (the dimension shown in FIG. 2). This enables the postcard 1 to be produced relatively simply. There is no necessity to stamp out individual components and then assemble them, to form the finished postcard. Instead, the sheet-form member 3, the transparent sheet 8 and the protective sheet 12 can all be formed in strip form. They are coated with the adhesive layers 6, 10 and then assembled to form a continuous strip having the section of FIG. 2. This strip can then be cut to form postcards having the desired width. This method of assembly is explained in greater detail below.

The postcard 1 in FIGS. 1 and 2 will usually be supplied in a closed configuration. To use the postcard 1, a user will lift the transparent sheet 8 together with the protective sheet 12, by grasping the tab 18. FIG. 2 shows the partially open position, and FIG. 8 indicates schematically the removal of the protective sheet 12. This enables the transparent sheet 8 to be peeled back, to reveal the first adhesive layer 6. At this time, the edge portions 14, 16 maintain the connection between the sheet-form member 3 and the transparent sheet 8. Then, a photograph, as indicated at 22 in FIG. 3, can be placed on the sheet-form member 3. The protective sheet 12 is then peeled off the second adhesive layer 10, to reveal it. To complete the postcard 1, the transparent sheet 8 is replaced and smoothed down, as indicated in FIG. 9. As a consequence, the photograph 22 will be adhered to both the first and second adhesive layers 6, 10. Also, outer, peripheral areas of the first and second adhesive layers 6, 10 will be adhered to one another. As a result, the photograph 22, together with the sheet-form member 3 and the transparent sheet 8 will form a single, rigid structure. It can be mailed like a conventional postcard, and should prevent any damage occurring to the photograph 22.

Whilst a wide variety of different materials and dimensions can be used for the postcard, details will be given of preferred dimensions and materials for an embodiment of the present invention.

For the sheet-form member 3, it is preferred that this is formed from cardboard sold under the name Kromecote (Registered Trade Mark), which has twelve point thickness (equivalent to 155 lbs/ream). One side of this material is matt and the other side is shiny. The matt side can be pre-printed in known manner to indicate a portion for a name and address, and another portion of a message. The other side is relatively glossy, and this is coated with the first adhesive layer 6. Preferably, this side of the sheet-form member 3 is first coated grey or another colour as indicated at 4. Then the adhesive layer 6 is applied and then pressure-sensitized.

The transparent sheet 8 is a laminate formed from polyester having two mil thickness. Other transparent materials instead of polyester can be used. It is coated with a layer of adhesive, which is pressure-sensitized, to form the adhesive layer 10. The optical characteristics of the first adhesive layer 6 are not important, although preferably it is transparent. For the second adhesive layer 10, since this is placed on top of the photograph 2, it should be transparent. For some purposes, it may be desirable to have the second adhesive layer 10 tinted.

The protective sheet 12 is formed from paper stock having a weight of 65 lbs/ream. It is coated on both sides with silicone. Prior to coating with silicone, its top surface is preferably pre-printed with instructions for use of the postcard or other information, as indicated at 26. Since this top surface is covered by the transparent sheet 8 and the second adhesive layer 10, the instructions or other information can readily be read when the postcard 1 is closed. As described above, the protective sheet 12 is first lifted up from the first adhesive layer 6. For this reason, it is desirable that the coating facing the first adhesive layer 6 has less adhesion that the coating facing the second adhesion layer 10. This can be achieved by providing a silicon coating 24 on the lower side of the sheet 12 which is thicker than a silicon coating 23 on the upper side thereof. Alternatively this can be achieved by using different coatings on its two sides. The coating 24 facing the first adhesive layer 6 should provide very little adhesion, so that the protective sheet 12 comes away readily from the sheet-form member 3. Greater adhesion should be provided between the top surface of the sheet 12 and the transparent sheet 8, so that a peel action is required to separate two components.

With regard to dimensions, all the components have a width of 6". The sheet-form member 3 has a height of $4\frac{1}{4}$". The two adhesive layers 6, 10 have a height of $4\frac{1}{4}$" as well. The edge portions 14, 16 have a height of $\frac{1}{4}$", whilst the tab 18 has a height of $\frac{1}{4}$". The transparent sheet 8 can have a height of $4\frac{1}{4}$", corresponding to the height of the sheet-form member 3. However, as shown by the enlarged thickness in FIG. 3, a photograph 22 will distort the transparent sheet 8. As a consequence, its lower edge will be pulled up towards the edge portions 14, 16. To allow for this, the overall height of the transparent sheet can be slightly greater than for $4\frac{1}{4}$", by an amount of, for example, 1/32". This will allow for this effect, so that for standard thickness photographs the lower edges of the sheet-form member 3 and the transparent sheet 8 should be flush with one another.

Reference will now be made to FIGS. 4, 5, 6 and 7, which show schematically steps in the method of production of a postcard in accordance with the present invention.

Firstly, the cardboard stock which is to form the sheet-form member 3 is coated with an adhesive which is then pressure sensitized. An intermediate liner or protective sheet 20 is then placed on the pressure-sensitized adhesive, to protect it. Then, the stock is slit or cut at $4\frac{1}{4}$" intervals (Or other desired interval), and wound onto individual cores. Consequently, each core will have a continuous strip of material 30 with the cross-section shown in FIG. 4. The sheet-form member 3 has the first adhesive layer 6, protected by the intermediate liner or sheet 20.

Separately, the transparent sheet or laminate stock is prepared. Again, it is coated with adhesive and pressure-sensitized. Stock for the protective sheet 12 is pre-printed on its top side, if desired. This stock is coated on both sides with silicone, with its lower side preferably having a different coating for easier release as outlined above.

Figure 5:
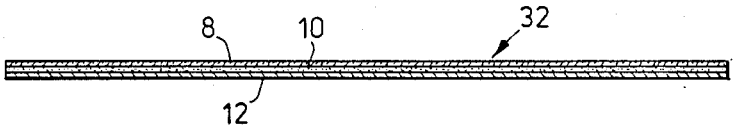
FIG. 5 shows a cross-section through other components of the postcard.

Then, the stock for the tranparent sheet 8 is combined with the stock for the protective sheet 12 to protect the adhesive layer. Again, this stock is cut to form continuous strips. However, it is cut at intervals equal to the intervals at which the stock for the sheet-form member 3 is cut plus the height of the tab 18. Where the sheet-form member 3 is $4\frac{1}{4}$" high and the tab is $\frac{1}{2}$" high, then this stock is cut at $4\frac{3}{4}$" intervals. FIG. 5 shows a cross-section of the resulting strips. Each has a lower portion forming the protective sheet 12 and an upper portion forming the transparent sheet 8, with the second adhesive layer 10 in between. This strip is generally designated by the reference 32. Again, each strip is wound on a separate core (not shown).

Figure 6:
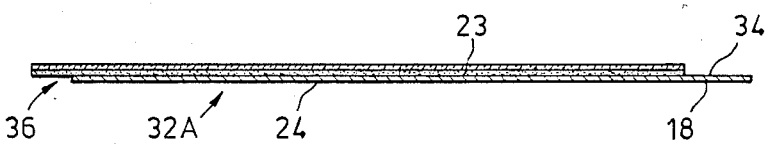
FIG. 6 shows a cross-section through the components of FIG. 5, with edge portions removed.

With reference to FIG. 6, each strip 32 is trimmed to reveal portions of the protective sheet 12 and the second adhesive layer 10. First, on edge portion of the transparent sheet 8, with an associated part of the adhesive layer 10, is removed as indicated at 34. This removed portion has a height which is slightly less than the tab 18, for reasons explained below. Also, as indicated at 36, one edge portion of the protective sheet 12 is removed, to reveal an edge portion of the adhesive layer 10. This removed portion is $\frac{1}{4}$" wide. The resultant modified strip is designated by the reference 32A.

Figure 7:
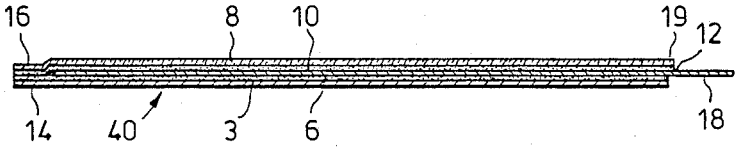
FIG. 7 shows a cross-section of a complete postcard assembled from the components of FIGS. 4 and 6, the section being actual size.

The stock strips 30, 32A are now ready to be combined. The intermediate liner or protective sheet 20 is removed and discarded. The two stock strips 30, 32A are then continuously brought up against one another, so that the protective sheet 12 is stuck to the first adhesive layer 6. Simultaneously, the edge portions 14, 16 of the sheet-form member 3 and the transparent sheet 8 are pressed together, to permanently secure them together by means of the exposed portions of the adhesive layers 6, 10. As shown in FIG. 7, the tab 18 is left as an extension of the protective sheet 12. Also, as mentioned above the edge portion of the transparent sheet 8 removed has a height less than the height of the tab 18, so that the transparent sheet 8 overhangs the sheet-form member 3 by an amount indicated at 19. This amount should be sufficient to make the member 3 and transparent sheet 8 flush when a photograph is mounted.

One then has a continuous strip designated by the reference 40, which has the section shown in FIG. 7. It is then cut into lengths, corresponding to the width required for the postcards. Preferably, it is cut into lengths of 6 inches.

The invention has been described in relation to conventional rectangular postcards, where the top and bottom edges are the longer sides of the card, and the shorter sides of the card form side edges. In the described embodiment, the transparent sheet is stuck or adhered to the sheet-form member along the upper side edge portion of the postcard. It is to be appreciated that these two components can be secured together along any edge of the postcard, and that other orientations of the postcard are possible. Thus, the transparent sheet and the sheet-form member could be secured together along their shorter sides. Also, the shorter sides of the postcard may form the top and bottom of the card. The method of producing the postcard described above is equally applicable to such an arrangement, with appropriate changes in the dimensions used.

The postcard and method of forming the postcard of the present invention are well-suited to cheap, mass-production. The various components of the postcard can be produced in continuous strips which are secured or mounted together as required. It is only at the final operation in the forming of the postcard that the resultant combined strip is cut into lengths. In contrast to handling a number of discrete rectangular components through various assembly stages, it is far easier and simpler to handle continuous strips of material.

I claim:

1. A postcard for use in mailing a sheet-form article with one side of such article visible, the postcard comprising:

(A) a sheet-form member formed from a relatively stiff material for supporting a sheet-form article and having a first layer of pressure-sensitive adhesive provided over all of one side of the sheet-form member; and (B) a relatively flexible laminate comprising:

(i) a transparent sheet having a second layer of generally transparent pressure-sensitive adhesive provided over all of one side of the transparent sheet facing the first layer of adhesive and with the transparent sheet permanently secured along one edge portion to a corresponding edge portion of the sheet-form member by corresponding edge portions of said layers of adhesive; and (ii) a protective release sheet positioned between the first and second layers of adhesive so as to maintain the sheet-form member and the transparent sheet separate, with the exception of said edge portions, which protective sheet includes a tab extending beyond an edge of the sheet-form member opposite the corresponding edge portion;

the adhesion between the protective release sheet and the sheet-forming member and relative to the adhesion between the protective release sheet and the transparent sheet being such that, in use, the protective sheet and the transparent sheet are movable as a unit to separate the same from the sheet-form member, and the relatively flexible laminate may be peeled back from the sheet-form member by use of the tab to enable positioning of the sheet-form article on the sheet-form member while the sheet-form article is viewed from the front thereof, the protective sheet being subsequently peelable away from the transparent sheet, whereby the article can be secured between the sheet-form member and the transparent sheet with one side of the article visible prior to mailing.

2. A postcard as claimed in claim 1, wherein both of the sheet-form member and the transparent sheet are rectangular.

3. A postcard as claimed in claim 2, wherein the width of the sheet-form member is the same as the width of the transparent sheet, and wherein the transparent sheet has a height slightly greater than the height of the sheet-form member, so that, in use, when the transparent sheet is placed over the top of a photograph, upper and lower edges of the sheet-form member and the transparent sheet are flush with one another.

4. A postcard as claimed in claim 1, wherein the sheet-form member is formed from card.

5. A postcard as claimed in claim 1, wherein the transparent sheet is formed from polyester.

6. A postcard as claimed in claim 1, wherein the protective sheet is formed from silicone coated sheet material.

7. A postcard as claimed in claim 1, wherein the protective sheet is printed with instructions on a surface facing the transparent sheet, which instructions can be read prior to opening the postcard.

8. A postcard as claimed in claim 1, wherein each of the first and second layers of adhesive is formed from a transparent and pressure-sensitive adhesive.

9. A postcard as claimed in claim 8, wherein the sheet-form member is provided with a grey coating on the side adjacent the first adhesive layer.

10. A postcard as claimed in claim 1, wherein the tab has a height of half an inch and said one edge portion has a height of one quarter of an inch.

11. A postcard as claimed in claim 10, wherein the sheet-form member has a height of four and a quarter inches and a width of six inches and wherein the transparent sheet has a height of 4 and 9/32 of an inch and a width of six inches.

12. A postcard as claimed in claim 1 or 10 wherein the postcard has a width of six inches and a height of four and a quarter inches.

13. A postcard as in claim 1 wherein peeling away of the protective sheet from the transparent sheet may be initiated by flexing of the transparent sheet adjacent the one edge portion sufficient to cause separation of the adjacent edge portion of the protective sheet from the transparent sheet enabling peeling of the protective sheet away from the one edge portion.

14. A postcard as in claim 1, wherein the tab is rectangular and extends across the width of the postcard and beyond the edges of the sheet-form member and the transparent sheet opposite the corresponding edge portions.

15. A postcard as in claim 1, wherein each of the sheet-form member, the transparent sheet and the protective sheet is of uniform cross-section in one direction.

16. A postcard as in claim 1 wherein such first layer of adhesive is transparent.

17. A postcard as claimed in claim 1, wherein the first layer of adhesive is provided all over one side of the sheet-form member and the second layer of adhesive is provided all over one side of the transparent sheet.

* * * * *